US007920073B2

(12) United States Patent
Woo et al.

(10) Patent No.: US 7,920,073 B2
(45) Date of Patent: Apr. 5, 2011

(54) METHOD AND TERMINAL FOR RECEIVING TRAFFIC INFORMATION AND METHOD FOR PROVIDING TRAFFIC INFORMATION

(75) Inventors: Sung Ho Woo, Goyang-si (KR); Jun Jeong Lee, Incheon (KR); Seon Hui Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 317 days.

(21) Appl. No.: 11/782,485

(22) Filed: Jul. 24, 2007

(65) Prior Publication Data

US 2008/0074290 A1 Mar. 27, 2008

(30) Foreign Application Priority Data

Sep. 25, 2006 (KR) ..... 10-2006-0092964

(51) Int. Cl.
*G08G 1/123* (2006.01)

(52) U.S. Cl. ..... 340/995.17; 340/995.1; 340/995.12

(58) Field of Classification Search ..... 340/988, 340/995.1, 995.11, 995.12, 995.13, 995.14, 340/995.17, 995.19, 995.23, 905; 342/357.1, 342/357.13; 701/117, 207
See application file for complete search history.

(56) References Cited

U.S. PATENT DOCUMENTS

| | | | | |
|---|---|---|---|---|
| 6,169,515 | B1 * | 1/2001 | Mannings et al. | 342/357.1 |
| 6,453,230 | B1 * | 9/2002 | Geurts | 701/117 |
| 6,662,105 | B1 * | 12/2003 | Tada et al. | 701/209 |
| 7,355,528 | B2 * | 4/2008 | Yamane et al. | 340/995.13 |
| 2004/0044468 | A1 * | 3/2004 | Adachi | 701/208 |
| 2008/0071466 | A1 * | 3/2008 | Downs et al. | 701/117 |

FOREIGN PATENT DOCUMENTS

EP 0 921 510 A2 6/1999

* cited by examiner

*Primary Examiner* — Van T. Trieu
(74) *Attorney, Agent, or Firm* — Birch, Stewart, Kolasch & Birch, LLP

(57) ABSTRACT

A method and terminal for receiving and processing traffic information and a method and apparatus for providing the traffic information, where the method for receiving traffic information includes reading region information included in received traffic information, determining whether a first region indicated by the region information overlaps with a second region corresponding to location information on which traffic information is desired, and decoding the traffic information including the region information indicating the first region if the determination result indicates that the first and second regions overlap.

6 Claims, 7 Drawing Sheets

METHOD AND TERMINAL FOR RECEIVING TRAFFIC INFORMATION AND METHOD FOR PROVIDING TRAFFIC INFORMATION

This application claims the priority benefit of Korean Patent Application No. 10-2006-0092964, filed on Sep. 25, 2006, which is hereby incorporated by reference as if fully set forth herein.

BACKGROUND OF THE INVENTION

1. Field of the Invention

The present invention relates to a method and terminal for receiving traffic information and a method and device for providing traffic information, and more particularly, to a method and device for encoding and providing traffic information and a method and terminal for decoding and outputting traffic information.

2. Discussion of the Related Art

As digital signal processing technologies and communication technologies have been increasingly developed and combined, radio-broadcast or TV-broadcast technology has been rapidly developed from analog broadcast technology to digital broadcast technology. In addition, data broadcast technology for broadcasting information related to daily life or broadcast programs through the digital broadcast technology has been developed.

Specifically, with the widespread use of vehicles throughout the world, the number of vehicles in urban or downtown areas, the number of people working for 5 day weeks, and the number of vehicles in rural districts are also rapidly increasing. Thus the necessity of informing drivers and others in the vehicles about traffic information is also increasing.

Due to the increasing need for the traffic information, radio broadcast programs from some radio broadcast stations provide the drivers with such traffic information according to a related art. However, it has a disadvantage in that it can provide the drivers with the traffic information only at specific times and thus the drivers cannot obtain the traffic information via the radio broadcast program at any time. Furthermore, traffic states or information changes in real time, but the above-mentioned radio broadcast stations cannot provide the drivers with correct traffic information varying with time.

In order to address the above-mentioned limitation, a variety of enterprises provide their subscribers with traffic information in real time through the terminals of the subscribers according to a related art. As a result, a variety of terminals, which are manufactured by different enterprises and have different functions, need to be able to commonly detect and analyze traffic information received via different digital broadcast channels and provide the users with the traffic information. Accordingly, a unified communication standard for transmitting/receiving the same signals (e.g., traffic information) between information providers and information users and analyzing the same signals is required.

In addition, all the received traffic information is decoded always in the users' terminals according to a related art. Thus, power may be unnecessarily consumed.

Furthermore, users who receive and use the traffic information may want to receive only necessary or certain traffic information. However, according to a related art, all the same traffic information is sent to all users and is decoded by their devices, regardless of the users' preferences to receive only certain portions of the traffic information.

SUMMARY OF THE INVENTION

Accordingly, the present invention is directed to a method and terminal for receiving traffic information and a method and device for providing traffic information that substantially obviate one or more problems due to limitations and disadvantages of the related art.

An object of the present invention is to provide a method and device for providing traffic information including region information so as to allow decoding of only necessary or certain information.

Another object of the present invention is to provide a method and apparatus for receiving traffic information including region information so as to decode only necessary or certain information.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other objects and other advantages and in accordance with the purpose of the invention, as embodied and broadly described herein, a method for receiving traffic information according to an embodiment includes: reading region information included in received traffic information; determining whether a first region indicated by the region information overlaps with a second region corresponding to location information on which traffic information is desired; and decoding the traffic information including the region information indicating the first region if the determination result indicates that the first and second regions overlap.

The region information may be included in a service component. The service component may include a congestion and travel time information (CTT) message.

In another aspect of the present invention, there is provided a terminal for receiving traffic information comprising: a broadcast module configured to receive the traffic information; a decoder configured to decode the traffic information; and a control unit configured to read region information from the traffic information received via the broadcast module, determine whether a first region indicated by the region information overlaps with a second region corresponding to location information on which traffic information is desired, and decode the traffic information including the region information indicating the first region if the determination result indicates that the first and second regions overlap.

In another aspect of the present invention, there is provided a method for providing traffic information, the method comprising: generating a traffic information message; generating a service component including region information and at least one traffic information message; and generating a transport frame including at least one service component.

According to an aspect of the present invention, there is provided a data structure embodied on a computer-readable medium, comprising: a service component including a field including at least one TPEG message, a field indicating an identifier for identifying the service component, a field indicating region information, and a field indicating a field length.

The computer-readable medium can be any portable or other types of storages or memories such as hard drive, RAM, ROM, PROM, etc. associated with one or more computers or computer-based devices such transmission/reception terminals or servers of the present invention. Alternatively, such computer-readable medium may be a different storage medium such as a USB, magnetic disc, optical disc, magneto-optical disc, etc. The present data structures embodied on the computer-readable mediums may also take the form of a signal propagating across the Internet, extranet, intranet or other network and arriving at the destination device for storage and implementation.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

A road searching service and a traffic information providing service according to the present invention can be applied to a variety of digital broadcast standards.

Representative examples of the digital broadcast standards are a European Digital Audio Broadcasting (DAB) service based on the Eureka-147 [ETSI EN 300 401] standard, a Digital Video Broadcasting-Terrestrial (DVB-T) service of Europe, a Digital Video Broadcasting-Handheld (DVB-H) service of Europe, a Media Forward Link Only (FLO) service of the United States, and a Digital Multimedia Broadcasting (DMB) service of the Republic of Korea.

The DMB service is generally classified into a Terrestrial Digital Multimedia Broadcasting (T-DMB) service based on the Eureka-147 standard and a Satellite Digital Multimedia Broadcasting (S-DMB) service using satellite communication.

Also, the traffic information providing service according to the present invention can be applied to the Internet, e.g., a Wi-Fi or Wireless Broadband Internet (Wibro), etc.

The term "traffic status" preferably is indicative of information on a traffic accident, an unexpected accident, a public transportation status, a congestion and travel time information (CTT) status, an emergency event, and/or a road transportation status, etc. However, it is not limited to the above-mentioned meanings and can be applied to other similar examples. For the convenience of description, a specific term "Transport Protocol Expert Group (TPEG)" is exemplarily used as the above-mentioned traffic information.

The term "traffic flow status" preferably is indicative of a traffic-flow status of roads, for example, a congestion of roads and travel time of transport means (e.g., car) on the roads. However, it is not limited to the above-mentioned meaning and can be applied to other similar meanings.

The term "section" or "link" preferably is indicative of a specific area of roads or a road segment which starts and ends at junctions and has no junction in between. However, it is not limited to the above-mentioned meaning and can be applied to other similar meanings.

The term "region information" preferably is indicative of a value (or parameter) for providing/identifying a certain region related to a location indicated by location information of a TPEG message which will be transmitted later. Such a value may be a coordinate value (minimum bounding rectangle (MBR) value) of a region obtained using an MBR method. However, this value is not limited to the coordinate value and any other value or parameter may be used if the value/parameter defines a regions.

Figure 1:
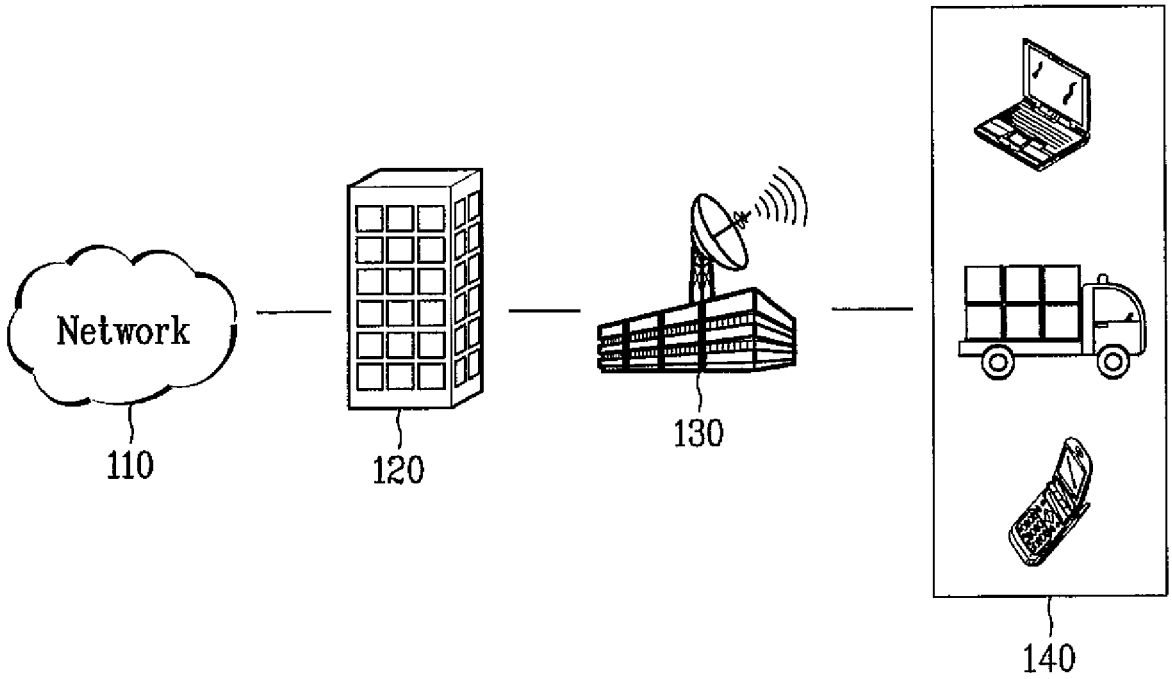
FIG. 1 is a view illustrating a network for providing traffic information according to an embodiment of the present invention.

FIG. 1 is a view illustrating an example of a digital multimedia broadcast system for providing traffic information according to the present invention. A method for providing traffic information using radio frequency (RF) signals will hereinafter be described with reference to FIG. 1.

The digital multimedia broadcast system includes a network 110 for collecting contents related to traffic information, a traffic information provision server 120 for providing the collected contents, a broadcast center 130, and a terminal 140. All the components of the digital multimedia broadcast system are operatively coupled and configured.

The traffic information provision server 120 of a broadcast station reconstructs a variety of traffic information received from other servers via a variety of paths such as an administrator network or the network 110, and transmits the received traffic information to traffic information receivers of a variety of terminals 140 such as a mobile phone, a vehicle, a personal digital assistant (PDA), or other hand-held terminals via transmitters) of the broadcast center 130.

The above-mentioned terminal 140 may further include a navigator or a computer such as a laptop computer, but is not limited to the above-mentioned examples, and can be applied to other examples. In this case, the traffic information provision server 120 may use a data channel of a digital broadcast service as a traffic information transmission path, a wired/wireless Internet, a broadband wireless medium such as a Wi-Fi or a Wibro, or other Internets based on wired cables, or other networks. Specifically, in a case of using a data service for a DMB service, the traffic information provision server 120 may also use a transparent data channel (TDC) protocol or multimedia object transport (MOT) protocol of a digital broadcast medium.

Figure 2:
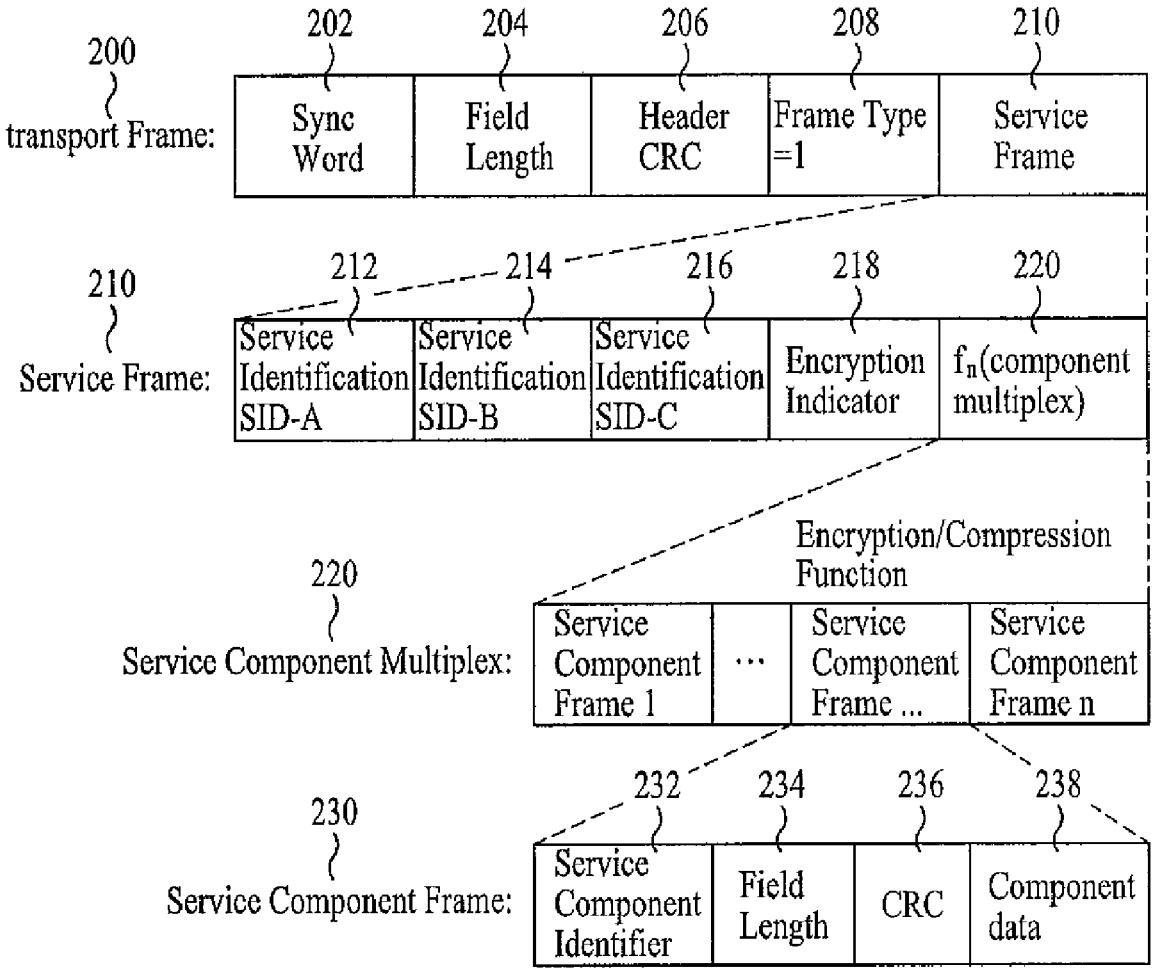
FIG. 2 is a view illustrating a general frame structure of traffic information which is wirelessly transmitted or received.

FIG. 2 is a view illustrating a frame structure of traffic information which is wirelessly transmitted or received, according to an embodiment of the present invention.

As shown in FIG. 2, traffic information according to the present invention is provided in at least one transport frame 200. The transport frame 200 includes a "Sync Word" field 202, a "Field Length" field 204, a "Header CRC" field 206, a "Frame Type" field 208 and a "Service Frame" field 210.

The "Sync Word" field 202 generally has 2 bytes and indicates a synchronization language. The "Field Length" field 204 generally has 2 bytes and indicates the number of bytes allocated to the "Service Frame" field 210. The "Header CRC" field 206 generally has 2 bytes and includes information used for correcting errors. The "Frame Type" field 208 generally has 1 byte and indicates the contents of the service frame. The transport frame 200 includes one "Service Frame" field 210. Generally a transport frame is used by a service provider and provides one service for supporting a variety of applications. The "Service Frame" field 210 includes service information such as service identification information and encryption information.

The "Service Frame" field 210 includes, for example, a "SID-A" field 212, a "SID-B" field 214, "SID-C" field 216, an "Encryption Indicator" field 218 and a "Component Multiplex" field 220.

The combination of the identification information of the "SID-A" field 212, the "SID-B" field 214 and the "SID-C" field 216" has a specific value. The "Encryption Indicator" field 218 generally has 1 byte. If the value of the "Encryption Indicator" field 218 is "00 hex", it indicates that data included in the "Component Multiplex" field 220 is not encrypted. If the "Encryption Indicator" field 218 has the other values, the "Encryption Indicator" field 218 indicates a data encryption and compression mechanism which can be used in data included in the next "Component Multiplex" field.

The "Component Multiplex" field 220 is a set of at least one service component frame, and the type or the order thereof is determined by the service provider. The "Component Multiplex" field 220 is changed by an indication method of the "Encryption Indicator" field 218. As described above, when the value of the "Encryption Indicator" field 218 is "00 hex", the multiplex is maintained without change.

The "Service Component Frame" field 230 included in the "Component Multiplex" field 220 includes a "Service Component Identifier" field 232, a "Field Length" field 234, a "CRC" field 236 and a "Component Data" field 238.

The "Service Component Identifier" field 232 has generally 1 byte, where the service component identifier having a value of "0" is reserved for a service network information (SNI) application. The "Field Length" field 234 generally has 2 bytes and indicates the number of bytes allocated to the "Component Data" field 238. The "CRC" field 236 generally has 2 bytes and includes information used for correcting error. The "Component Data" field 238 includes a variety of TPEG messages. Information included in the TPEG message includes, but is not limited to, congestion and travel time information (hereinafter, referred to as 'CTT'), public transport information (hereinafter, referred to as 'PTI'), road traffic message (hereinafter, referred to as 'RTM'), travel information, point of interest (hereinafter, referred to as 'POI'), news information and weather information. Other information and other traffic information can be provided in the TPEG messages.

The SNI application is used for identifying whether next component data is the CTT, the PTI, the RTM, the travel information, the POT, the news information, or the weather information.

Figure 3:
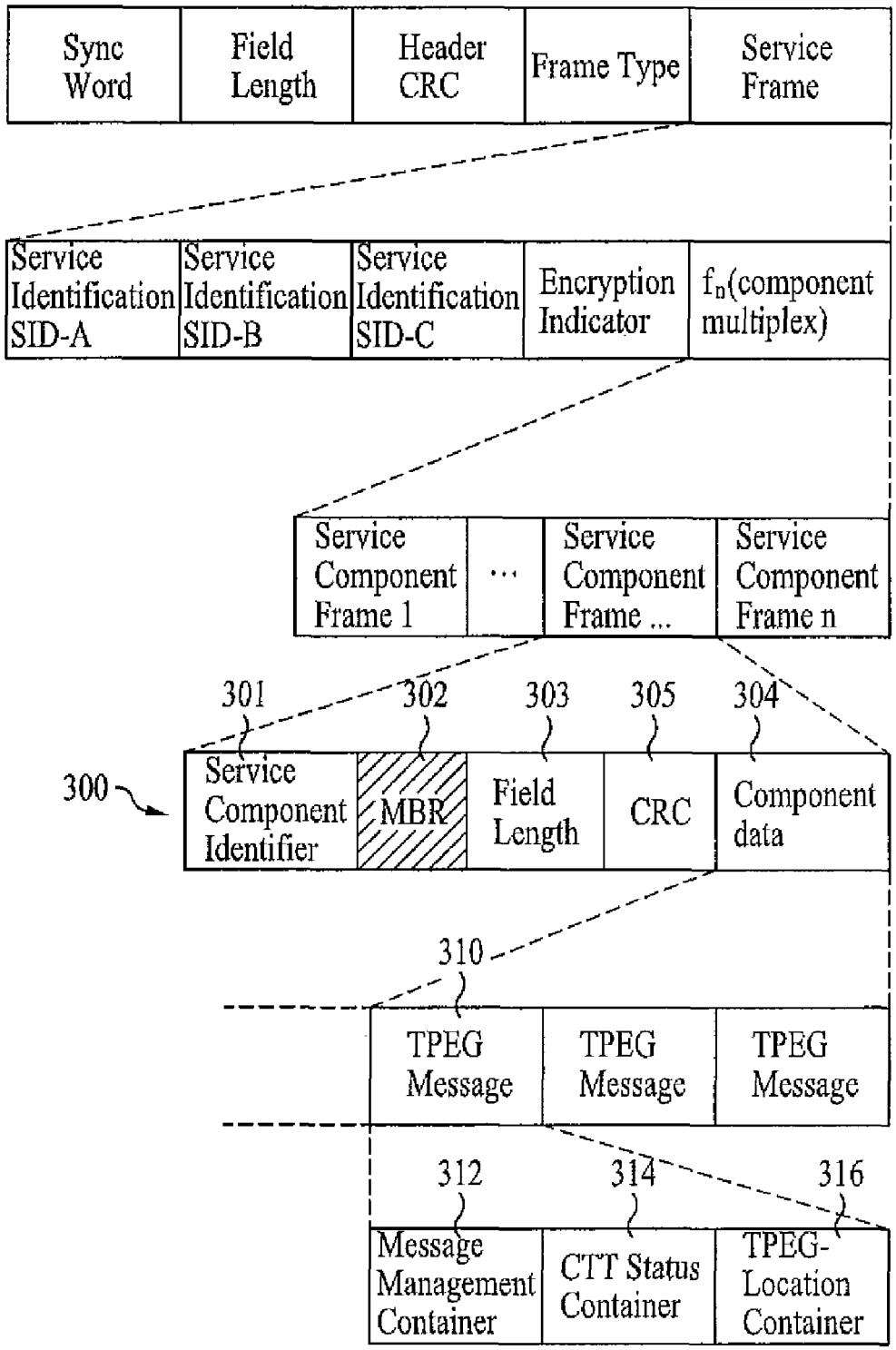
FIG. 3 is a view illustrating a frame structure of traffic information including minimum bounding rectangle (MBR) information according to an embodiment of the present invention.

FIG. 3 is a view illustrating a frame structure of traffic information including MBR (minimum bounding rectangle) information according to an embodiment of the present invention.

As shown in FIG. 3, a service component frame 300 of a transport frame for carrying information such as traffic information includes a "Service Component Identifier" field 301, a "Field Length" field 303, a "CRC" field 305 and a "Component Data" field 304. According to this embodiment of the present invention, the service component frame 300 further includes an "MBR" field 302 for storing region information. The transport frame of FIG. 3 also includes other fields (e.g., a "Sync Word" field, a "Field Length" field, a "Header CRC" field, and a "Frame Type" field) corresponding to the fields of the transport frame 200 of FIG. 2. The transport frame of FIG. 3 can be generated and transmitted by the traffic information provision server 120.

The "Component Data" field 304 included in the service component frame 300 includes at least one TPEG message 310.

If the TPEG message 310 includes, for example, the CTT, the TPEG message can include a "Message Management Container" field 312 including a component for managing the message, a "CTT Status Container" field 314 including a CTT status, and a "TPEG-Location Container" field 316 including location information corresponding to the CTT status.

The CTT depends on location information, and the location information included in the "TPEG-Location Container" field 316 is defined by referring to a location using a coordinate system or by referring to a location using a predefined node link ID. As an example, in the Republic of Korea, the whole country is divided into about 65,000 links. However, one service component includes only information on at most 255 links. A value indicating a region including the links included in one service component is referred to as a region value. A value indicating a region corresponding to the location information included in the "TPEG-Location Container" field 316, such as a location indicated by a node name or a location using the coordinate system, may also be referred to as a region value. For convenience of description, for example, the value indicating the region including the links will be described.

The region information included in the "MBR" field 302 indicates the region value. The region value may be a value (MBR value) obtained by a MBR method. Alternatively, the region value may be a value obtained using a minimum bounding radius method or other methods. In such cases, the field 302 would carry the region value obtained by the minimum bounding radius method or other methods, and the name of the field 302 can be changed as desired. Hereinafter, for convenience of description, for example, an example of a region value obtained by the MBR method will be described. However, it is apparent that a region value obtained using the other methods may be equally used according to the present invention.

Figure 4:
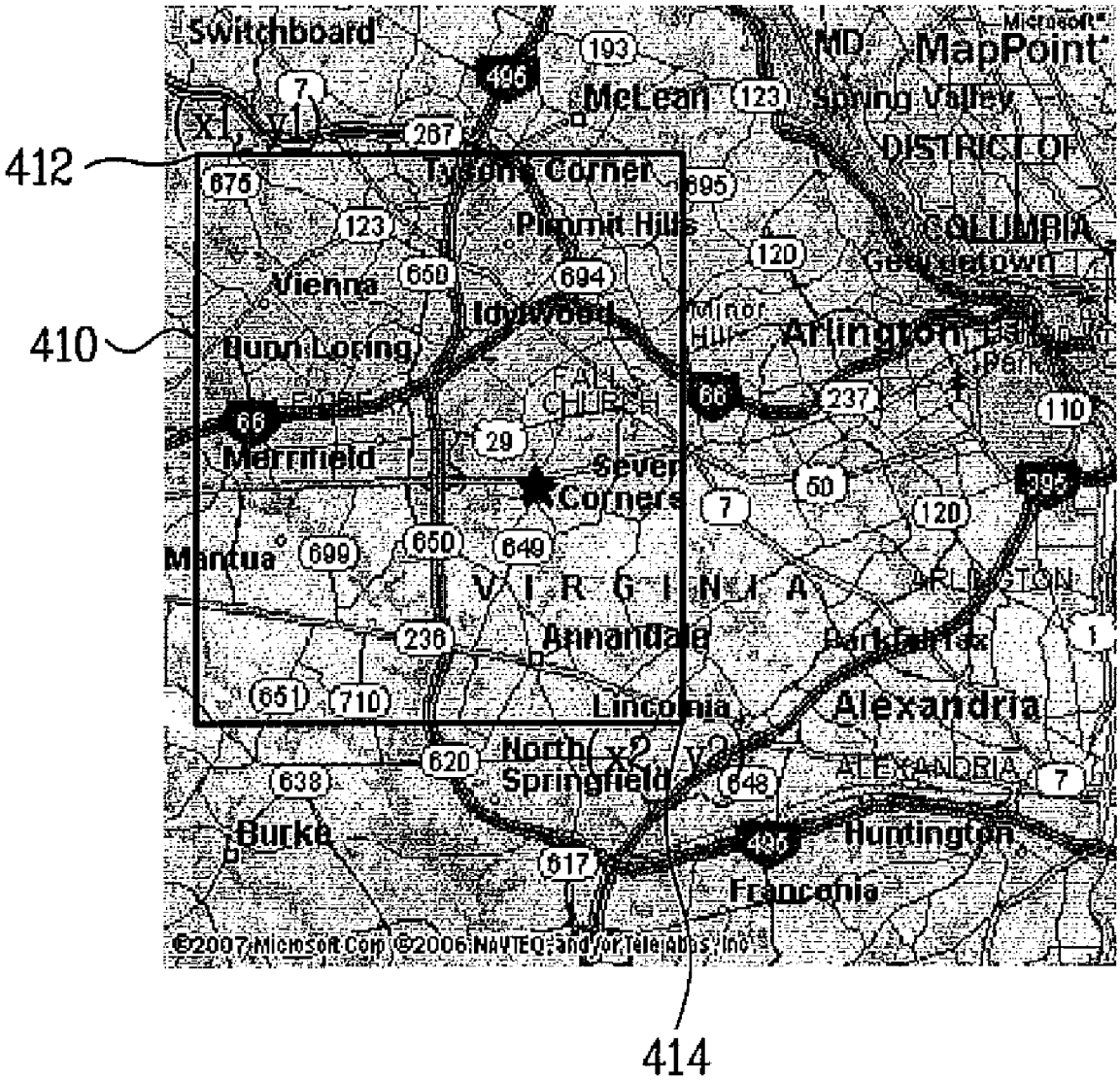
FIG. 4 is a view illustrating an example of an MBR structure according to the present invention.

FIG. 4 is a view illustrating an example of a map showing an MBR structure according to the present invention. As an example only, the map shows an area in Korea.

As shown in FIG. 4, a left top vertex 412 and a right bottom vertex 414 in a certain region (MBR) 410 on the map are expressed by x and y coordinate values. For example, the MBR 410 shown in FIG. 4 has a coordinate value (x1, y1) and a coordinate value (x2, y2). Accordingly, in this example, the region value included in the "MBR" field 302 of the service component as shown in FIG. 3 is the MBR (410) value having the coordinate value (x1, y1) and the coordinate value (x2, y2). That is, the MBR value having the coordinate values (x1, y1) and (x2, y2) would be provided in the "MBR" field 302.

The service component frame 300 also includes TPEG messages related to the links belonging to the MBR, such as a CTT message. As described above, the TPEG message is included in the "Component Data" field 304 of the service component frame 300.

Figure 5:
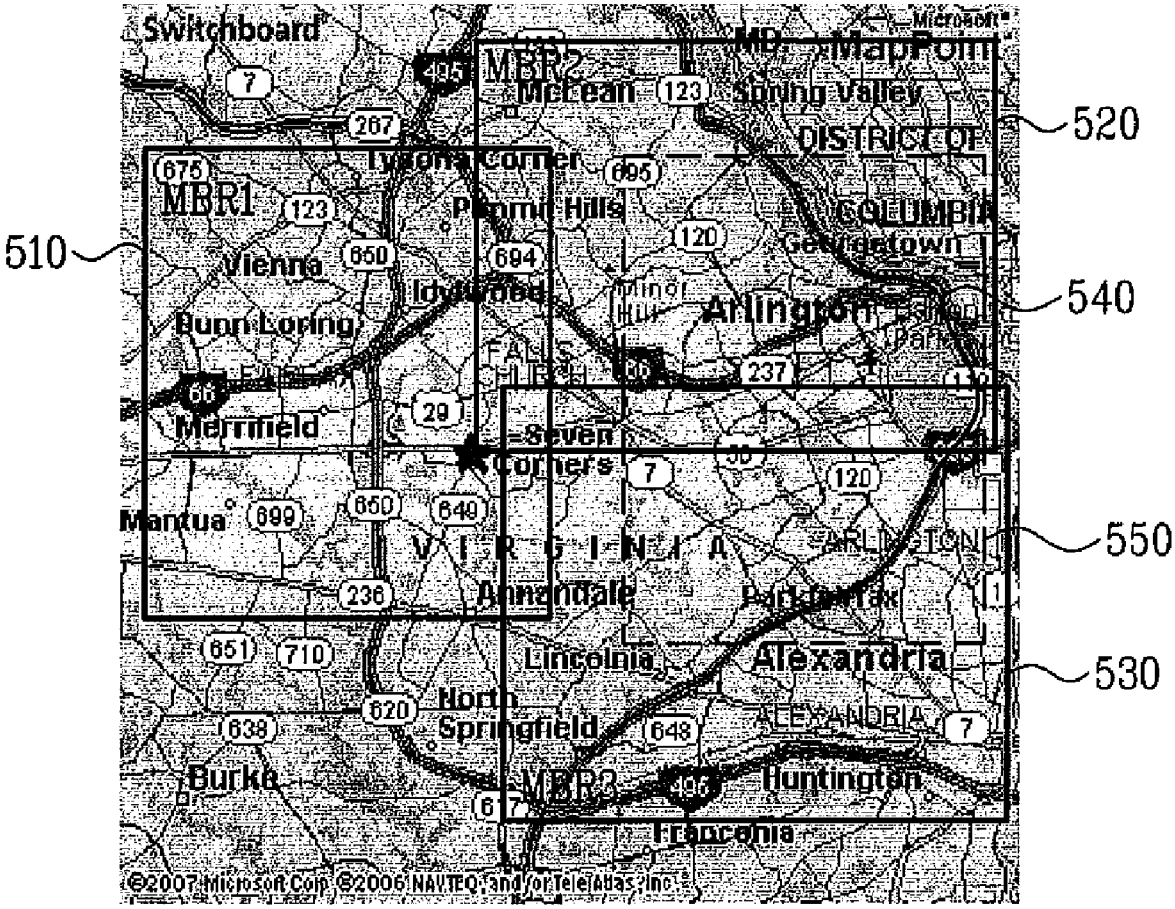
FIG. 5 is a view illustrating an example of an MBR structure used for extracting information according to an embodiment of the present invention.

FIG. 5 is a view illustrating an MBR structure used in a method for extracting information according to an embodiment of the present invention. The method for extracting and decoding only necessary (or certain) traffic information using the MBR will now be described with reference to FIG. 5 as an example. This method, however, is equally applicable to a region defined by other methods such as a minimum bounding radius method.

As shown in FIG. 5, the map shown is identical to the map shown in FIG. 4. In this example, three MBRs (MBR1 510, MBR2 520 and MBR3 530) are shown. Among the MBR1 510, MBR2 520 and MBR3 530, only the MBR2 520 and the MBR3 530 include an MBR 550 (indicated by large-dotted line), which is set as a region including a path 540 specified by a user. For instance, when the user sets or defines the user-preferred path 540 (on which the user desires to receive traffic or other information), a region (MBR 550) based on this path 540 (e.g., region including this path 540) is identified. Then, in this example, only the MBR2 and MBR3 include the MBR 550 and thus only the information associated with the MBR2 and MBR3 is accessed and decoded for the user. Accordingly, only the service components related to the MBR2 520 and the MBR3 530 are parsed and decoded, and the service component related to the MBR1 510 (which is unrelated to the path 540) is not decoded and can be eliminated.

For convenience of description, although a case where the user inputs the path using a navigator is described in the above example, an MBR 550 including the location of the user acquired using a GPS (or other method) can also be used.

In order to decode the traffic information requested by the user, it is determined whether the MBR including the location or the path input by the user overlaps with any MBR included in the service components, and only the service components) including the MBR(s) that overlap with the MBR of the user's location/path are parsed and decoded. As a result, the present invention prevents the terminal from decoding all received information, which wastes resources and is not beneficial to the user.

Figure 6:
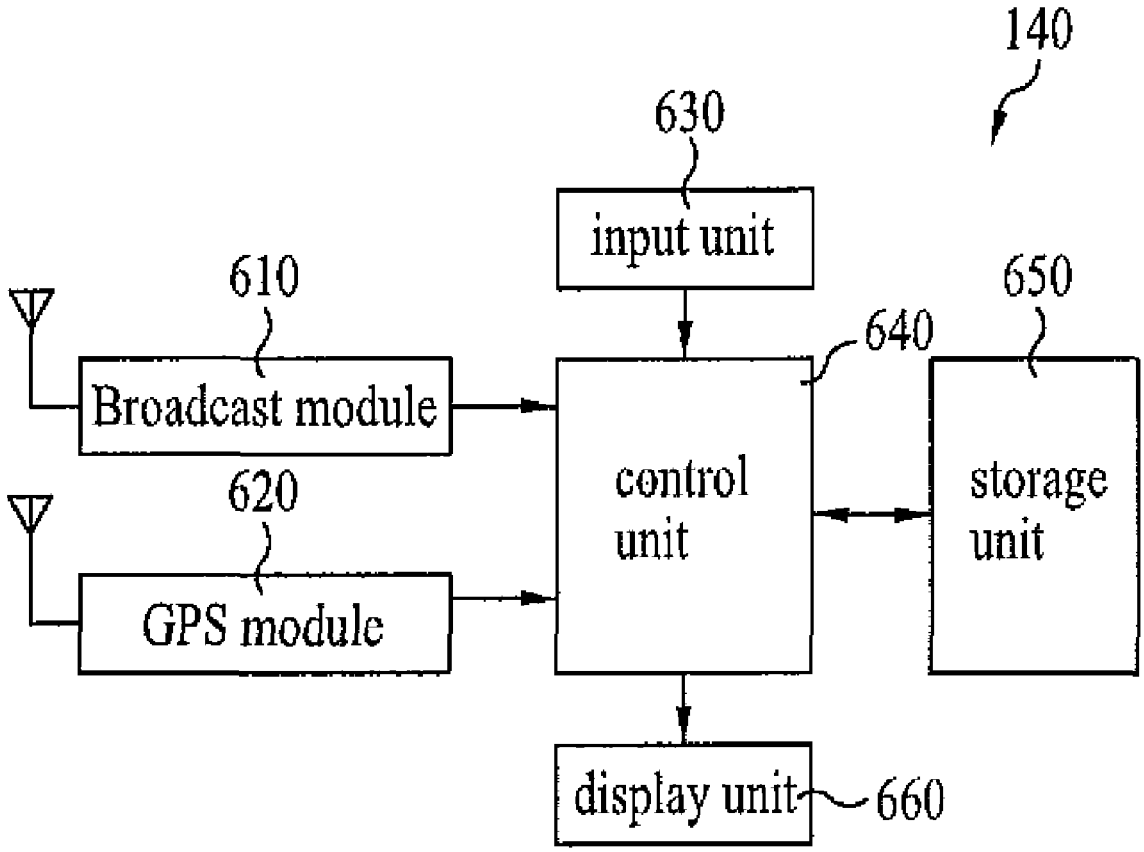
FIG. 6 is a block diagram illustrating the configuration of an apparatus for decoding traffic information according to an embodiment of the present invention.

FIG. 6 is a block diagram illustrating the internal configuration of an apparatus for receiving and decoding traffic information according to an embodiment of the present invention. Particularly, FIG. 6 schematically illustrates the internal configuration of a terminal 140 (FIG. 1) for receiving the traffic information transmitted from the traffic information provision server 120, according to an embodiment of the present invention. The terminal 140 can be a mobile terminal.

As shown in FIG. 6, the terminal 140 using the received traffic information includes a broadcast module 610, a GPS module 620, an input unit 630, a control unit 640, a storage unit 650, and a display unit 660. All the components of the terminal 140 are operatively coupled and configured.

The broadcast module 610 receives broadcast signals transmitted from the broadcast center via broadcast channel (s). The broadcast module 610 may be a portion of a wireless transmission/reception unit including a transmission/reception circuit for wirelessly transmitting/receiving sound and control information to/from a base station.

The GPS module 620 receives satellite signals transmitted from a plurality of low-earth-orbit satellites and recognizes current location information (e.g., a longitude, a latitude, an altitude, etc.) of the terminal 140 or other desired entity.

The input unit 630 includes a plurality of key buttons or the like for inputting numerals and others such as telephone numbers, generates key data when a user presses a predetermined key, and outputs the generated key data to the control unit 640. The input unit 630 may include one or more of a keypad, a jog shuttle, a point stick, a touch screen, etc.

The control unit 640 controls the operations of the terminal 140. The control unit 640 can preferably include an arithmetic and logic unit, a register, a program counter, a command decoder and a control circuit and can properly control the whole operation of the terminal 140.

The storage unit 650 stores at least one program for controlling the operations of the terminal 140. Data, which is input/output when the operations of the terminal 140 are performed by the control unit 640, can be stored in a predetermined area of the storage unit 650. The storage unit 650 can be an internal memory, a removable memory, hard drive, etc.

The display unit 660 preferably includes at least one liquid crystal display unit (or other types of displays) for displaying a variety of information, and displays the current status of the terminal 140 such that the user may perform proper control. On the liquid crystal display screen, a variety of information such as a power status, the strength of a received electromagnetic wave, a date and time, a current mode, or other user information can be displayed. The user can confirm and control the status of the terminal 140 of FIG. 6 by displaying such information to the user.

Hereinafter, the functions of the components of the present invention according to an embodiment will be described in detail. Referring to FIG. 6, the broadcast module 610 transmits the traffic information received via the broadcast channel to the control unit 640. For example, the broadcast module 610 outputs a traffic information signal modulated in synchronization with a signal band for providing the traffic information to a demodulator, and the demodulator demodulates the modulated traffic information signal and outputs the demodulated traffic information signal to the control unit 640. The control unit 640 acquires a variety of traffic information by selectively decoding the demodulated traffic information signal. The storage unit 650 stores an electronic map including information on the links and the nodes and a variety of graphic information. The storage unit 650 also stores the received traffic information during a predetermined period. The control unit 640 controls the screen output based on the input information of the user input by the input unit 630, the current location recognized by the GPS module 620 and the traffic information acquired by the broadcast module 610. The display unit 560 displays an image (e.g., the decoded traffic information) using a drive signal according to a graphic transmitted from the control unit 640.

The broadcast module 610 receives the traffic information signal, which is transmitted from the traffic information provision server 120 via the broadcast center 130, tunes the received signal, demodulates the tuned signal using a predetermined method, and outputs the demodulated signal. Then, the control unit 640 decodes the demodulated signal, analyzes the TPEG messages in the traffic information, and controls the image display of the display unit 660 using a control signal and/or necessary information according to the message contents. When the demodulated signal is the traffic information, a TPEG decoder for decoding the traffic information may be further included or the control unit 640 may include a decoding function. In the present invention, for convenience of description, for example, a case where the control unit has the decoding function will be described.

The control unit 640 according to the embodiment of the present invention reads region information included in the traffic information and determines whether a region indicated by the region information includes a region on which traffic information is desired to be provided. The control unit 640 can determine whether the received traffic information is to be decoded or not, according to the result of the determination. For example, when the user inputs a path (or location) about which the user desires to receive information (e.g., traffic information), the control unit 640 calculates an MBR value corresponding to the path and compares a region having the calculated MBR value with a region indicated by the region value (e.g., in the MBR field 302) included in the service component provided in the received traffic information (transport frame). When an overlapped portion exists in the both regions as a result of the comparison, the control unit 640 parses and decodes only that service component having that region value. That is, if the comparison result indicates that the region defined by the user's MBR value overlaps the region defined in the MBR field 302 of the service component frame being compared, then that service component frame is selected and decoded. As a result, information (e.g., traffic information) pertaining to the user's path/location is provided to the user while information on other regions are neither decoded nor provided to the user.

As described above, the region value preferably has x and y coordinate values included in the "MBR" field 302 provided in the service component frame 300. The MBR value of the path (which is, e.g., input by the user) is obtained by allowing the control unit 640 to set the MBR including the path and to express the left top vertex and the right bottom vertex with x and y coordinate values. The TPEG message included in the service component frame may be the CTT. When the CTT is included in the service component frame, the MBR value included in the service component frame may be the region value of the region including the links corresponding to the location information included in the CTT message.

Then, as described above, the control unit 640 decodes the traffic information selected using the region, analyzes the TPEG messages in the decoded traffic information, and controls the image display of the display unit 660 using a control signal and/or information according to the message contents. When the terminal shown in FIG. 6 includes sound output means, the TPEG message requested by the user may be output by sounds through the sound output means.

Figure 7:
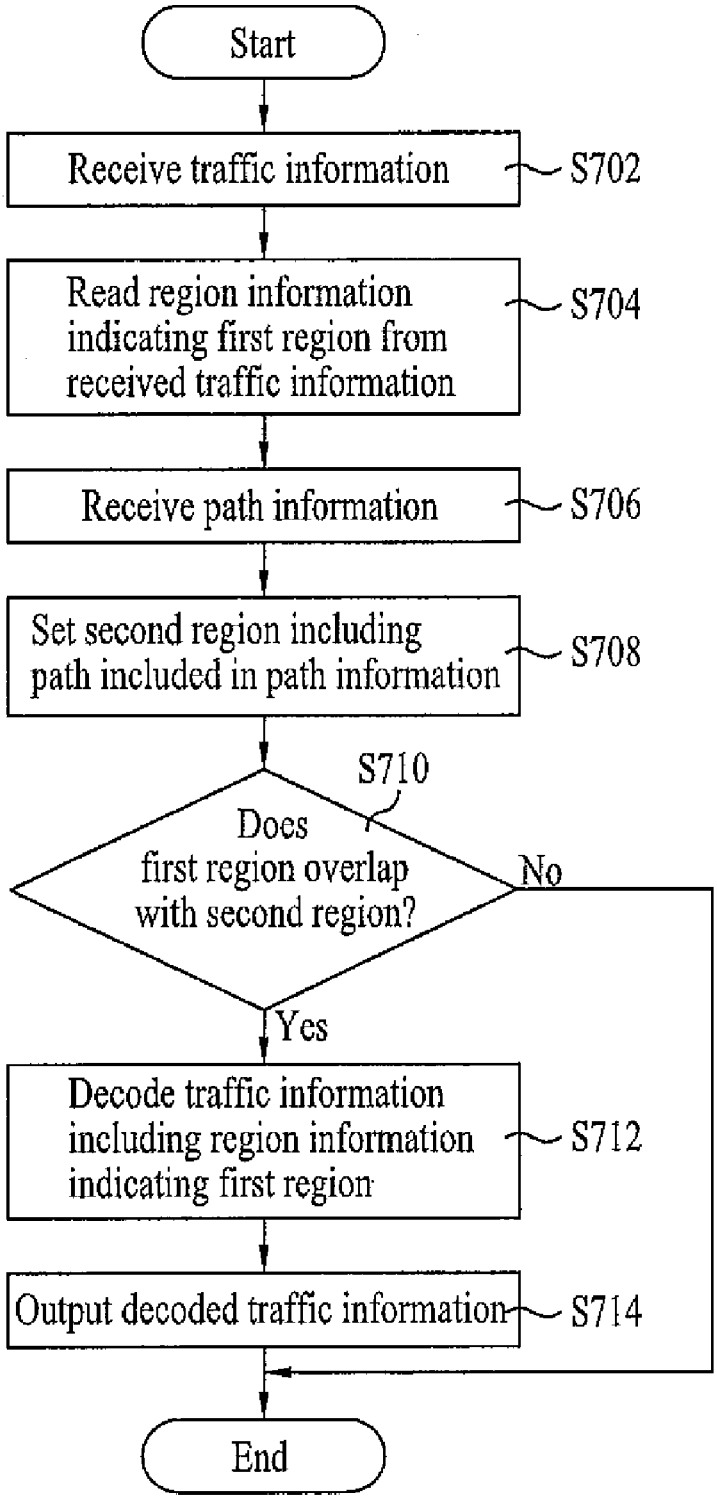
FIG. 7 is a flowchart illustrating a method for decoding traffic information according to an embodiment of the present invention.

FIG. 7 is a flowchart illustrating a method for decoding traffic information according to an embodiment of the present invention. The method of FIG. 7 can be implemented in the terminal of FIG. 6 and the system of FIG. 1 using the frame structure of FIG. 3, but can also be implemented in other suitable device/system.

Referring to FIG. 7, first, the control unit 640 receives the traffic information via the broadcast module 610 (S702).

The control unit 640 reads region information indicating a region included in the received traffic information (S704). For convenience of description, the region information can include a region value having two x and y coordinate values, and the region indicated by the region value is referred to herein as a first region. The region value indicating the first region is included in the "MBR" field 302 included in the service component frame 300 provided in the transport frame.

The control unit 640 receives information on a path, a location, a destination, an area, or the like (also referred to as 'location information') via the input unit 630 (S706). This location information may be a path determined by a departure point and a destination point, which are input by the user, or a user location (e.g., address, etc.) acquired using the GPS module 620 or others, or an area defined by the user using the input unit, or other parameter input by the user.

The control unit 640 sets a region including the path provided in the path information and calculates a region value (e.g., an MBR value) having two x and y coordinate values (S708). The region including the path is referred to as a second region for the sake of convenience only. The order of steps 702, 704, 706 and 708 may be changed. For example, steps 706 and 708 may be performed prior to step S702.

The control unit 640 determines whether the first region acquired in step S704 overlaps with the second region acquired in step S708 (S710). Here, the overlapping can be a partial overlap or a full overlap.

As a result of the determination in step S710, if the first region overlaps with the second region, the control unit 640 parses and decodes only the traffic information (e.g., service component frame) including the region information on the first region (S712). That is, the control unit 640 decodes only the service component frame (or the traffic information contained therein) containing the first region information accessed in step 704. The traffic information is preferably included in the service component frame having the "MBR" field 302 including the region information on the first region, and may be, for example, the CTT message.

The control unit 640 outputs the traffic information decoded in step S712 (S714). The control unit 640 analyzes the TPEG messages in the decoded traffic information, and controls the image display of the display unit 660 using the control signal and/or information according to the message contents. When the sound output means is included, the TPEG message requested by the user may be output by sound through the sound output means.

For convenience of description, although the MBR method is used and discussed referring to FIG. 5, the present invention is not limited thereto and any method may be used if the region can be defined.

According to the present invention, since unnecessary information is not decoded and only the information (e.g., traffic information) requested by a user is decoded, it is possible to prevent power from being wasted due to decoding of unnecessary information.

According to the present invention, it is also possible to prevent a data processing speed from decreasing due to decoding of unnecessary traffic information.

Furthermore, the user is fully satisfied with the output traffic or other information because it focuses on the path/location/region of the user's interest.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for receiving traffic information by a mobile terminal, the method comprising:

receiving a service frame including service component frames and an encryption indicator field indicating a data encryption mechanism, wherein each of the service component frames includes a MBR (minimum bounding rectangle) field containing a first MBR value and a component data field containing a corresponding traffic information message for informing the mobile terminal of a corresponding traffic situation, wherein the traffic information message is encoded by the data encryption mechanism, wherein each traffic information message includes location information corresponding thereto, and wherein the first MBR value of each service component frame indicates a first region to which the location information corresponds;

reading the first MBR values from the service component frames;

generating a second MBR value indicating a second region determined based on a current location of the mobile terminal for receiving the traffic information or a path comprising a departure point and a destination point;

selecting at least one MBR value by comparing the first MBR values with the second MBR value, wherein the first region indicated by the at least one first MBR value overlaps with a second region indicated by the second MBR value; and decoding the traffic information message included in the component data field corresponding to the at least one first MBR value by using the data encryption mechanism, wherein one of the first region and the second region is obtained by using a minimum bounding rectangle (MBR) method or a minimum bounding radius method.

2. The method of claim 1, wherein the traffic information message further includes a congestion and travel time information (CTT) message.

3. A mobile terminal for receiving a plurality of traffic information, comprising:

a broadcast module configured to receive service frame including service component frames and an encryption indicator field indicating a data encryption mechanism, wherein each of the service component frames includes a MBR (minimum bounding rectangle) field containing a first MBR value and a component data field containing a corresponding traffic information message for informing the mobile terminal of a corresponding traffic situation, wherein the traffic information message is encoded by the data encryption mechanism, wherein each traffic information message includes location information corresponding thereto, and wherein the first MBR value of each service component frame indicates a first region to which the location information corresponds;

a decoder; and a control unit operatively connected to the broadcast module and decoder, the control unit configured to read the first MBR values from the service component frames;

generate a second MBR value indicating a second region determined based on a current location of the mobile terminal for receiving the traffic information or a path comprising a departure point and a destination point;

select at least one MBR value by comparing the first MBR values with the second MBR value, wherein the first region indicated by the at least one first MBR value overlaps with a second region indicated by the second MBR value; and decode the traffic information message included in the component data field corresponding to the at least one first MBR value by using the data encryption mechanism, wherein one of the first region and the second region is obtained by using a minimum bounding rectangle (MBR) method or a minimum bounding radius method.

4. The terminal of claim 3, further comprising:

a global positioning system (GPS) module, wherein the current location of a terminal is acquired by using the GPS module.

5. The terminal of claim 3, further comprising:

an input unit, wherein the departure point and the destination point are input through the input unit.

6. The terminal of claim 3, wherein the traffic information message includes a congestion and travel time information (CTT) message.

* * * * *